United States Patent [19]

Abraham

[11] Patent Number: 4,662,067

[45] Date of Patent: May 5, 1987

[54] APPARATUS AND METHOD FOR PROVIDING ORIENTATION OF A COAX CABLE HAVING A GROUND TERMINATION BAR

[75] Inventor: Ronald F. Abraham, Phoenix, Ariz.

[73] Assignee: Honeywell Information Systems Inc., Phoenix, Ariz.

[21] Appl. No.: 849,085

[22] Filed: Apr. 7, 1986

[51] Int. Cl.[4] ..... H01R 4/66; H01R 43/04

[52] U.S. Cl. ..... 29/861; 29/749; 339/14 R; 339/143 R

[58] Field of Search ..... 29/857, 861, 753, 749, 29/33 M; 339/14 R, 143 R, 176 MF, 218 M

[56] References Cited

U.S. PATENT DOCUMENTS

| | | | |
|---|---|---|---|
| 4,243,290 | 1/1981 | Williams | 339/143 R |
| 4,345,811 | 8/1982 | Volka | 339/143 R |
| 4,365,856 | 12/1982 | Yaegashi et al. | 339/14 R |
| 4,420,201 | 12/1983 | Stephenson | 339/14 R |
| 4,457,575 | 7/1984 | Davis et al. | 339/143 R |

*Primary Examiner*—Z. R. Bilinsky

*Attorney, Agent, or Firm*—A. A. Sapelli; J. S. Solakian; A. Medved

[57] ABSTRACT

A connector for providing electrical connections for a coax cable harness, the coax cable harness including a plurality of coax cables, each coax cable having a wire encased in a dielectric and having a drain wire. The connector comprises an insulation displacement connector having a plurality of insulation displacement contacts set in a top surface of the insulation displacement connector. Each insulation displacement contact engages a corresponding wire encased in the dielectric, the insulation displacement contact piercing the dielectric thereby providing the electrical connection for the wire of the coax cable. An orientation bar positions the coax cables to be in line with the corresponding insulation displacement contact, the coax cables resting on a top surface of the orientation bar. The orientation bar is positioned next to the insulation displacement connector such that a side surface of the insulation displacement connector is in contact or nearly in contact with the orientation bar. The orientation bar further has a plurality of holes from the top surface which extend to a bottom surface of the orientation bar, each hole being positioned under the corresponding coax cable in order to permit the corresponding drain wire of the coax cable to be inserted through the hole with the end portion of drain wire bent across the bottom surface of the orientation bar. A ground termination block, having a top surface placed opposite the bottom surface of the orientation bar and fixed against the drain wires bent across the bottom surface of the orientation bar, causes the drain wires to be in pressure contact between the ground termination block and the orientation bar, wherein at least one of the ground termination block or the orientation bar is made of an electrically conducting material.

13 Claims, 8 Drawing Figures

APPARATUS AND METHOD FOR PROVIDING ORIENTATION OF A COAX CABLE HAVING A GROUND TERMINATION BAR

BACKGROUND OF THE INVENTION

This invention relates to an electrical connector, and more particularly, to an electrical connector of the insulation displacement connector-type and a method for connecting a plurality of coax cables to a predetermined contact of the electrical connector and providing a common ground termination in conjunction therewith.

There is currently available insulation displacement connectors which are used to produce a cable harness whereby a wire having some dielectric covering (insulation) is forcibly inserted into a contact, the contact being structured to pierce or cut through the insulation and to make contact with the metal conductor (i.e., wire) thereby eliminating the step of stripping the insulation from the wire before making the electrical connection of the wire to the contact. The insulation displacement connector (IDC) contact has been developed such that a highly reliable electrical connection is made and has proved to be a highly efficient technique for connecting ribbon cables. No other connections are required when wires of the type mentioned above are used in conjunction with the insulation displacement connector. However, when a plurality of coax cables form the cable harness, an additional connection must be made; namely, the drain wire (i.e., ground shield and/or the ground wire) must also be connected to a common electrical terminal.

There presently exists coaxial ribbon cable consisting of individual coaxial cables encased in a PVC jacket making up a standard flat ribbon cable configuration. Each coaxial lead has a solid center conductor (wire) and a foil shield with a drain wire. This construction allows the cable to be cut in any length maintaining the exact positioning of the center conductor (wire) and drain wire.

Through the use of stripping and terminating equipment, well known to those skilled in the art, all conductors are stripped simultaneously and mass terminated. On the connector, the signal conductors (i.e., wires) are terminated on one side of the connector and the drain wires are attached to the opposite side (the connector having two rows of contacts). These operations greatly reduce assembly time, damage and overall applied cost. However, one row of contacts is dedicated to terminating the drain wires, thereby cutting in half the amount of contacts available for connecting the signal conductors (i.e., wires).

The ground termination block provided by the present invention allows all of the contacts of the connector to be utilized for the signal conductors of the coax cable, and also provides for using individual coax cables, rather than ribbon cable, for the cable harness. Existing ribbon cable drain wires are in between signal conductors and dielectric materials limiting the size of the diameter of the dielectric, thereby limiting higher range of characteristic impedances of the coax. An orientation bar of the present invention aligns the drain wires to allow for maximum dielectric diameters, thereby maximizing the higher characteristic impedance range of the coax cable. Further, when the contacts of the connector are used to terminate the drain wire, the diameter of the drain wire must be the same or nearly the same of the wire since the contacts on the IDC are the same physical size. In the present invention, since the contacts of the connector are not utilized to terminate the drain wires, no such requirement exists.

The present invention permits the use of coax cables with the readily available and relatively inexpensive IDC connectors by providing a ground termination bar for making the common ground termination, while still maintaining a relatively simple method of making the connection of the wire and the drain wire. The use of the ground termination bar also allows all the contacts of the connector to be available for signal conductors (wires).

SUMMARY OF THE INVENTION

Therefore, there is supplied by the present invention a connector for providing electrical connections for a coax cable harness, the coax cable harness including a plurality of coax cables, each coax cable having a wire encased in a dielectric and having a drain wire. The connector comprises an insulation displacement connector having a plurality of insulation displacement contacts set in a top surface of the insulation displacement connector. Each insulation displacement contact engages a corresponding wire encased in the dielectric, the insulation displacement contact piercing the dielectric thereby providing the electrical connection for the wire of the coax cable. An orientation bar positions the coax cables to be in line with the corresponding insulation displacement contact, the coax cables resting on a top surface of the orientation bar. The orientation bar is positioned next to the insulation displacement connector such that a side surface of the insulation displacement connector is in contact or nearly in contact with the orientation bar. The orientation bar further has a plurality of holes from the top surface which extend to a bottom surface of the orientation bar, each hole being positioned under the corresponding coax cable in order to permit the corresponding drain wire of the coax cable to be inserted through the hole with the end portion of drain wire bent across the bottom surface of the orientation bar. A ground termination block, having a top surface placed opposite the bottom surface of the orientation bar and fixed against the drain wires bent across the bottom surface of the orientation bar, causes the drain wires to be in pressure contact between the ground termination block and the orientation bar, wherein at least one of the ground termination block or the orientation bar is made of an electrically conducting material.

The present invention also includes a method of connecting a coax cable harness to a connector, the coax cable harness including a plurality of coax cables, each coax cable having a wire encased in a dielectric and having a drain wire, and each coax cable having been stripped of an outer jacket and accompanying shield. The connector includes an insulation displacement connector having insulation displacement contacts, and an orientation bar positioned next to the insulation displacement connector. The orientation bar has holes along the length of the orientation bar for each coax cable position opposite each insulation displacement contact. Also, each drain wire of the coax cable is bent at about right angles to the length of the coax cable at the point where the outer jacket has been stripped. The method comprises the steps of inserting the drain wire in a first hole of the orientation bar such that the coax cable is resting essentially on a top surface of the orientation bar, bending the end portion of the drain wire, which extends from outside the hole at the bottom surface of the orientation bar, parallel to the coax cable, and forcibly inserting the wire encased in the dielectric in the corresponding insulation displacement contact. These steps are repeated for the next adjacent coax cable until all the coax cables have been connected to the corresponding insulation displacement contact. A ground termination block is placed along the bottom surface of the orientation bar such that the drain wires are between the orientation bar and the ground termination block. The ground termination block is then fastened to the orientation bar such that the drain wires are held in pressure contact with the ground termination block.

Accordingly, it is an object of the present invention to provide a connector for connecting coax cables.

It is another object of the present invention to provide a connector for connecting the drain wire of the coax cables to a common termination.

It is still another object of the present invention to provide a connector for connecting each wire of the coax cables to a predetermined contact of the connector.

It is still a further object of the present invention to provide a connector for connecting the drain wires of the coax cable to a common termination and for connecting the wires of the coax cables to predetermined contacts of the connector.

It is still another object of the present invention to provide a connector for connecting the drain wires of the coax cables to a common termination and for connecting the wires of the coax cables to predetermined contacts of the connector, whereby all the contacts of the connector are utilized for connecting the respective wire.

It is still another object of the present invention to provide a method for making the connection of the wire and the drain wire to the electrical connector.

These and other objects of the present invention will become more apparent when taken in conjunction with the following description and attached drawings, wherein like characters indicate like parts, and which drawings form a part of the present application.

BRIEF DESCRIPTION OF THE DRAWINGS

FIG. 1, shows a cut-away isometric view of a coax cable as utilized in conjunction with a connector of the present invention;

FIG. 3, shows a top view of an orientation bar in position with an insulation displacement connector at the start of the assembly process;

DETAILED DESCRIPTION

Figure 1A:
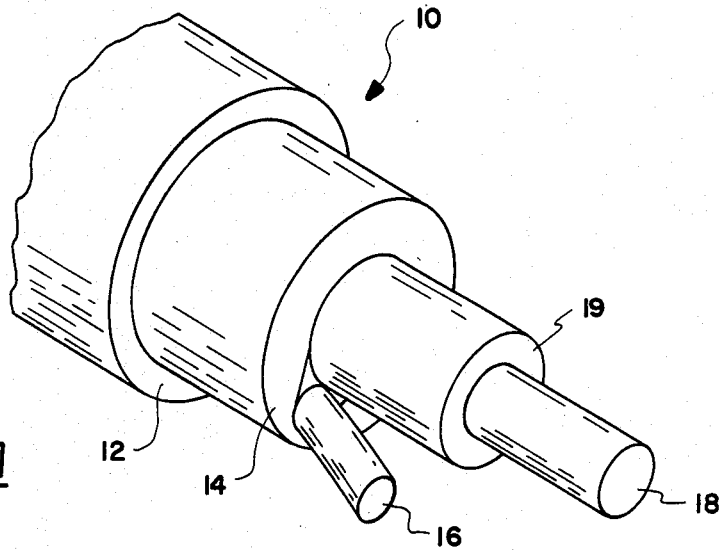
FIG. 1A, which together with FIG. 1B comprise
Figure 1B:
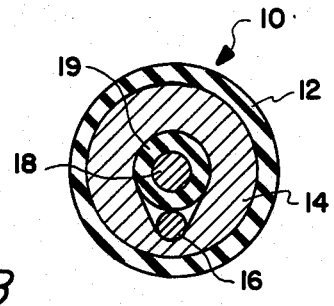
FIG. 1B shows a cross-sectional view of the coax cable of FIG. 1A.

Referring to FIG. 1, being comprised of FIGS. 1A and 1B, FIG. 1A shows a cut-away isometric view of a coax cable as utilized in conjunction with an electrical connector (or more simply referred to herein as a connector) of the present invention, and FIG. 1B shows a cross-sectional view of the coax cable. The coax cable 10 consists of a wire 18 (also referred to herein as a metal conductor, and a signal conductor), having a dielectric covering 19 (also referred to herein as insulation). Surrounding the insulation 19 is a metallic foil 14 (which can also be a braided wire or other type of metallic substance for providing a shield for the wire 18. Enclosed inside the metallic foil 14 is a drain wire 16 which makes electrical contact with the metallic foil 14. The metallic foil 14 is then encased in an outer jacket 12 of some insulation material.

Figure 2:
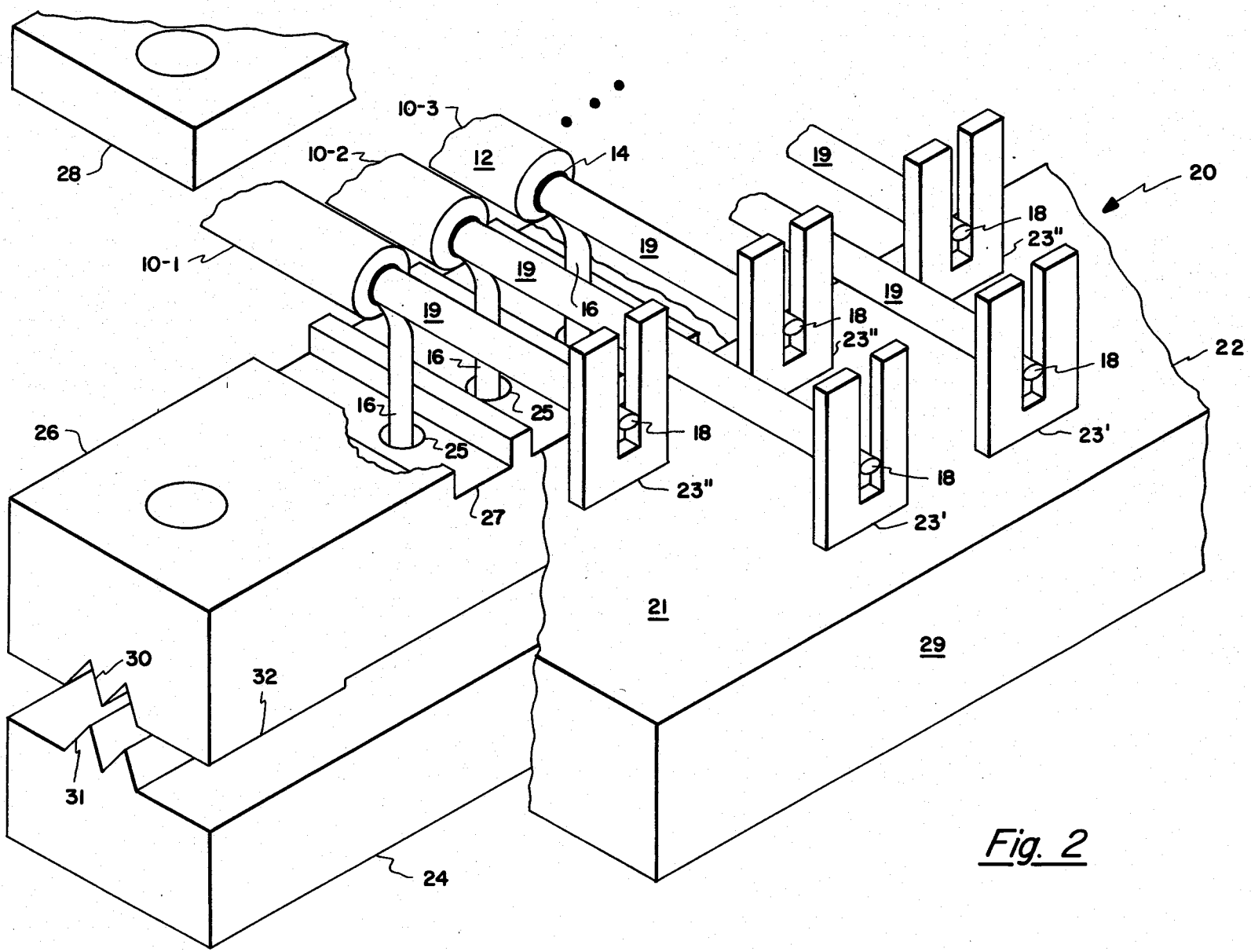
FIG. 2 shows an isometric view of the connector of the preferred embodiment of the present invention.

Referring to FIG. 2, there is shown an isometric view of the connector 20 of the preferred embodiment of the present invention. The connector 20 of the present invention includes an insulation displacement connector (IDC) 22 which is readily available from connector manufacturers, such as AMP. The IDC 22 as shown, has two rows of contacts 23' and 23'', also referred to herein as a front row (or first row) 23', and a back row (or second row) 23''. The contacts 23 are set in the IDC 22 such that the contacts 23 have an extension embedded into the body of the IDC 22 and protrude from another surface for making contact with a backplane or printed circuit board (not shown since it has no bearing on the present invention). The part of the contacts 23 shown extending above a top surface 21 of the IDC 22 include that portion for connecting the coax cable 10 to the contact 23. It is this part of the contact 23 which will be discussed. Included as part of the connector 20 is an orientation bar 26 and a ground termination block 24. Coax cables 10 have been stripped of some of the outer jacket 12 and metallic foil 14 such that a predetermined length of the insulation 19 containing wire 18, and drain wire 16 are exposed. The stripping can be accomplished through the use of stripping and terminating equipment well known to those skilled in the art; the stripping process will not be discussed further herein since it forms no part of the present invention. The insulation 19 and the wire 18 have been stripped the predetermined length such that the length extends beyond the front surface 29 of the IDC 22, the length extension not shown for clarity, but will be discussed further hereinunder. The drain wire 16 of each coax cable 10 is bent at approximately 90° to the length of the coax cable such that the drain wire 16 can be inserted into a corresponding hole 25 in the orientation bar 26. The orientation bar 26 contains a plurality of slots 27 such that each coax cable 10 fits within the slot 27. The drain wire 16 is then wrapped around the bottom of the orientation bar such that the drain wire 16 goes across a W-shaped indentation 30 which is cut into the bottom surface of the orientation bar 26 and extends the entire length of the orientation bar 26. The slot 27 of the orientation bar serves to position and orient each coax cable 10 such that the drain wire 16 is facing downward, and positions and holds the coax cable 10 in line with the corresponding contact 23. The insulation 19 and wire 18 extends across or slightly above the top surface of the IDC 22 and is inserted into the corresponding contact 23 such that alternate coax cables 10 are connected to contacts 23 within the same row. Thus, the insulation 19 and wire 18 of coax cable 10-1, 10-3, 10-5 (not shown) . . . are connected to corresponding contacts 23'' in the back row. In a like manner coax cable 10-2, 10-4 (not shown) ... are connected to the corresponding front row contacts 23'. A top bar 28 is set across the coax cables 10 and the ground termination block 24 is set across the bottom of the orientation bar 26 and fastened together thereby holding the coax cables 10 in position. In the preferred embodiment of the present invention the orientation bar 26 is made of a molded plastic and the ground termination block 24 is made of a metallic substance. The ground termination block 24 has a w-shaped protrusion 31 which corresponds to the indentation 30 and lines up with the indentation 30 of the orientation bar 26. By clamping the orientation bar 26 to the ground termination block 24, with the drain wires 16 all extending across the indentation 30, all the drain wires 16 are thus electrically connected to the ground termination block 24, the ground termination block providing the common termination for all the drain wires 16. A step 32 is provided at the two ends of the orientation bar 26 on the surface which mates with the ground termination bar 24 such that a space is provided for the drain wires. It is desirable that the drain wires only be pierced by the protrusion 31 of the ground termination bar 24, thereby avoiding a shearing of the drain wire 16. Such a shearing action could cut the drain wire 16 and thus make an unreliable contact of the drain wire 16 to the ground termination block 24.

Figure 3A:
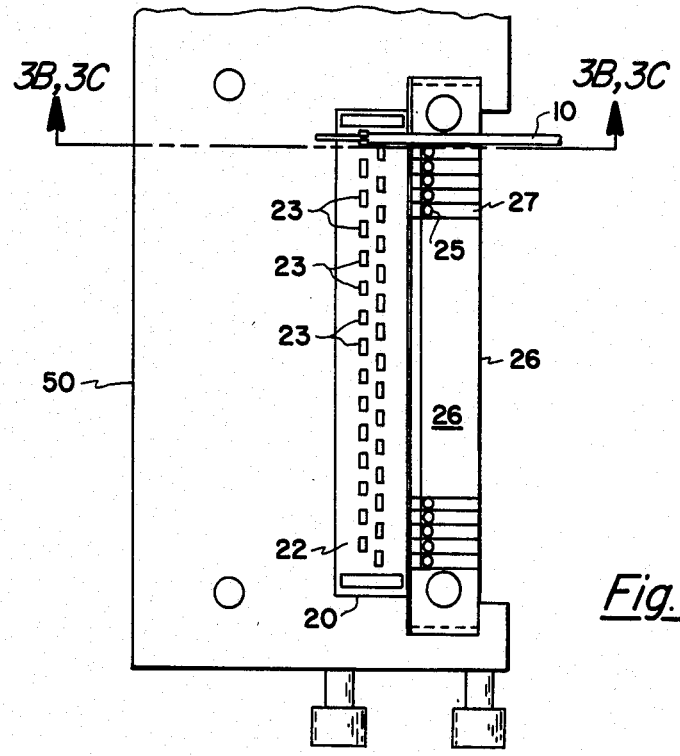
FIG. 3A, which together with FIGS. 3B and 3C comprise
Figure 3B:
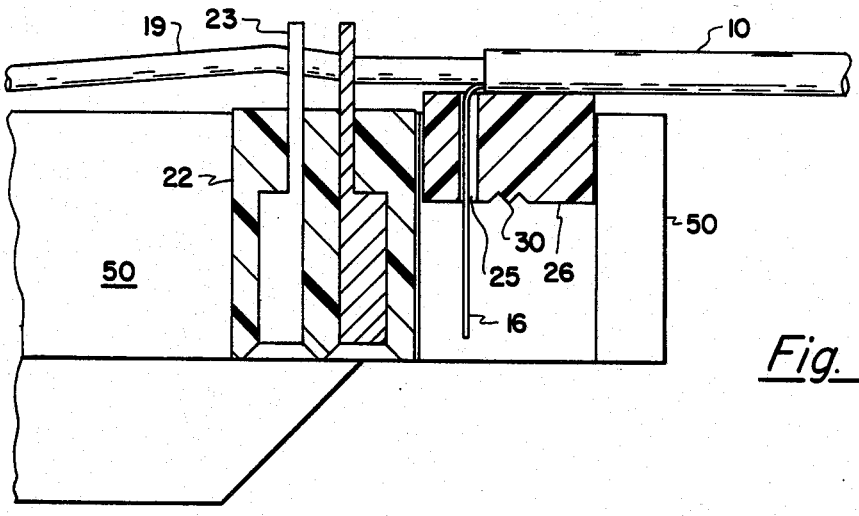
FIG. 3B shows section A—A of FIG. 3A with the connector of the present invention partially assembled.
Figure 3C:
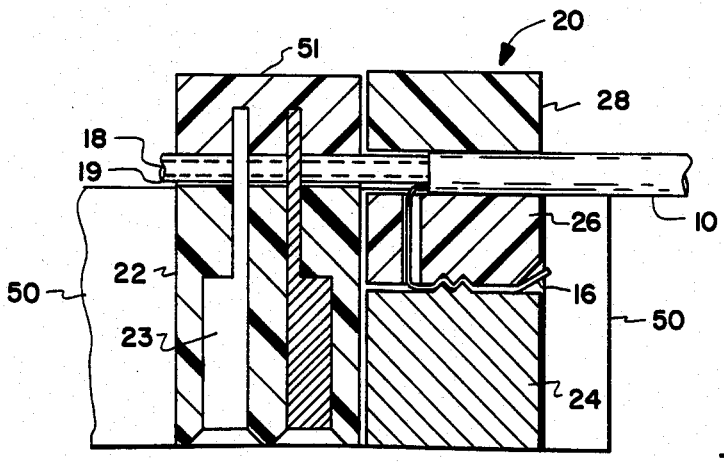
FIG. 3C shows section A—A FIG. 3A of the completed connector.

Referring to FIG. 3, which is comprised of FIGS. 3A, 3B, and 3C, the assembly process of the cable harness will be described. FIG. 3A shows a top view of the orientation bar 26 in position with IDC connector 22 at the start of the assembly process. FIG. 3B shows section A—A of FIG. 3A with the connector 20 partially assembled. FIG. 3C shows section A—A of the completed connector 20. As described above, a plurality of coax cables 10 are stripped such that a predetermined amount of the outer jacket 12 and metallic foil 14 are removed leaving a predetermined length of the drain wire 16 and a predetermined length of the insulation 19 containing wire 18. The length of the drain wire 16 is sufficiently long to fit through hole 25 and bend across the indentation 30 of the orientation bar 26. The insulation 19 containing wire 18 is sufficiently long to be inserted into a corresponding contact 23 and extend beyond the IDC connector allowing an assembler to make the proper insertion of the insulation 19 into the corresponding connector 23. The orientation bar 26 and IDC connector 22 are mounted into a fixture 50. A second fixture 50 (not shown) also contains a second IDC connector 22 (not shown) and a second orientation bar 26' (not shown) for the opposite end of the cable harness. A first coax cable 10 having been previously stripped the predetermined lengths at both ends has the drain wire 16 inserted into the first hole 25 of the orientation bar 26 and the remainder of the coax cable 10 inserted into the corresponding slot 27, the insulation 19 containing the wire 18 being inserted into the corresponding contact 23. The other end of the first coax cable 10 is likewise inserted into the corresponding first position of the second orientation bar 26' (not shown) in a like manner as described above. In this manner, the individual coax cable 10 has been inserted into the first position of the two connectors 20 at both ends of the cable. A second coax cable is then inserted into the second position of the first connector 20. The assembler continues the process until all the available positions have a coax cable 10 (or all the positions as previously determined, in the preferred embodiment 30 positions exist and hence there are 30 coax cables 10 making up the coax cable harness). After the assembler has inserted the 30th coax cable 10 there should be no available positions in the connectors 20 at both ends of the cable harness. After all 30 coax cables 10 have been inserted, the top bar 28 is placed on the top surface of the orientation bar 26 and across the coax cables 10. The ground termination block 24 is placed under the orientation bar 26, and the top bar 28, the orientation bar 26, and the ground termination block 24 are fastened together. The connector 20 can then be removed from the fixture 50 and the insulation 19 containing the wires 18 and the drain wires 16 are then trimmed flush with the surface of the IDC connector 22 and the orientation bar 26, respectively. A simple visual inspection of the connectors at both ends would verify that all the positions are occupied thereby eliminating the electrical check, commonly known as "ringing-out" the cable can be eliminated. As shown in FIG. 3C a dielectric covering 51 can be placed over the contacts 23 to further install the drain wires 16 into the contacts 23 and also to avoid any physical damage to the contacts 23.

Figure 4:
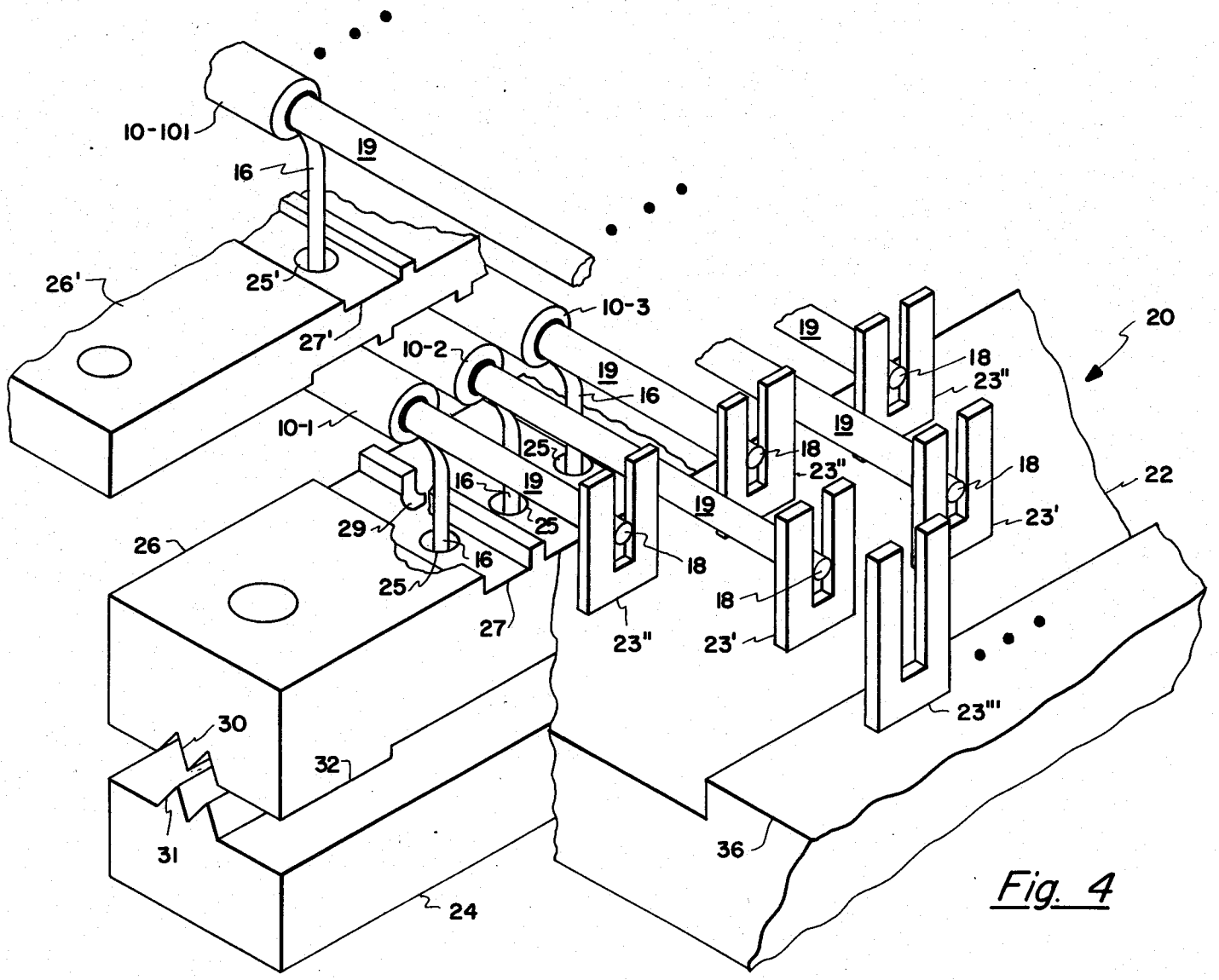
FIG. 4 shows an alternative embodiment of the connector of the present invention.

Many alternatives embodiments and modifications can be made which are intended to be within the scope of the present invention. Referring to FIG. 4 there is shown an alternative embodiment in which the coax cables 10 are in more than a single plane (i.e., co-planar). A cable harness can be made embodying the present invention which includes a second plane of coax cables 10-101. A second orientation bar 26' having notches 27' are positioned such that the drain wire 16 of the coax cable 10-101 is inserted into hole 25' of the second orientation bar 26' and made to be oriented opposite a corresponding hole 29 in the orientation bar 26. The drain wire 16 of coax cable 10-101 passes between coax cables 10-1 and 10-2. Additional coax cables 10-102, 10-103, (not shown) . . . are oriented in corresponding slots 27' of second orientation bar 26', the corresponding drain wire fitting into a corresponding hole 25' of second orientation bar 26' and the corresponding hole 29 of orientation bar 26. The contact 23''', which is utilized to make the connection of the wire 18 corresponding to coax cable 10-101, can be on a pedestal 36 of the IDC connector 22, or the contact 23''' may be sufficiently high to engage the insulation 19 and corresponding wire 18 of coax cable 10-101 without interfering with the connections made by the contacts of the first and second row, 23', 23''. It is understood that in this embodiment, the spacing between contacts 23 in the first row and the second row is sufficiently far apart, or the diameter of the coax cables 10 is sufficiently small, such that there is sufficient space for the drain wires 16 of coax cable 10-101 to fit between adjacent coax cables 10 (i.e., coax cables 10-1 and 10-2).

Figure 5:
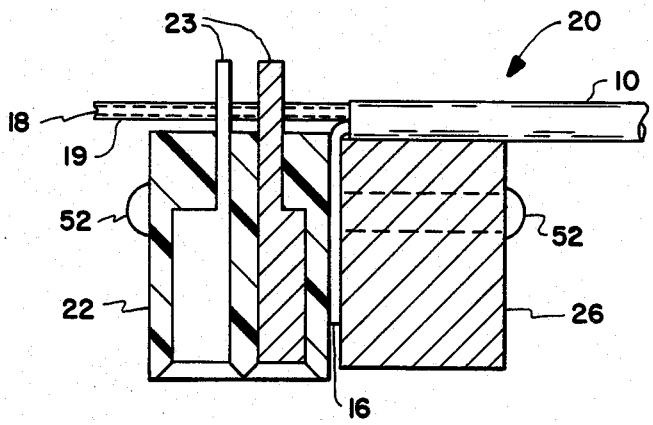
FIG. 5 shows still another alternative embodiment of the connector of the present invention.

Referring to FIG. 5, there is shown still another alternative embodiment of the present invention. In the configuration of the connector 20 of FIG. 5, a more simple embodiment is shown. The orientation bar 26 is shown made of an electrically conducting material (i.e., a metallic substance) which is positioned next to the IDC connector 22 such that the insulation 19 containing the wire 18 of the coax cable 10 is positioned to a corresponding IDC contact 23. The drain wire 16 is positioned along a side surface of IDC connector 22 and a side surface of the orientation bar 26 with the coax cable 10 resting along the top surface of the orientation bar 26. At the ends of the orientation bar 26 and IDC connector 22, holes are provided for fastening IDC connector 22 to orientation bar 26 such that pressure is exerted against the drain wire 16. (The fastening can be accomplished by a fastener 52.) In this manner all the drain wires 16 are making physical contact with orientation bar 26. This arrangement holds drain wires 16 in place as a result of the pressure between the orientation bar 26 and the IDC connector 22, and also serves to hold the coax cables 10 in position. Such an arrangement may be suitable when little or no stress is placed upon the coax cables 10. For a more firm holding arrangement of coax cables 10, a top bar 28 (not shown) may be placed across the top surfaces of the coax cable 10 and fastened to orientation bar 26 as done in the preferred embodiment described above. Also, a dielectric covering (not shown) can be placed over the contacts 23 as discussed above in connection with the preferred embodiment.

While there has been shown what is considered to be the preferred embodiment of the present invention, it will be manifest that many changes and modifications can be made therein without departing from the essential spirit and scope of the invention. It is intended, therefore, in the annexed claims, to cover all such changes and modifications which fall within the true scope of the invention.

I claim:

1. A connector, for providing electrical connections for a coax cable harness, wherein the coax cable harness includes a plurality of coax cables, each coax cable having a wire encased in a dielectric and having a drain wire, said connector comprising:

(a) an insulation displacement connector, having a plurality of insulation displacement contacts made of an electrically conducting material and set in a top surface of said insulation displacement connector and arranged in at least one row, each insulation displacement contact engaging a corresponding wire encased in said dielectric, said insulation displacement contact piercing said dielectric thereby providing the electric connection for the wire of the coax cable;

(b) orientation bar means, for positioning said coax cables to be in line with the corresponding insulation displacement contact, said coax cables resting on a top surface of said orientation bar means, said orientation bar means being positioned next to said insulation displacement connector such that a side surface of said insulation displacement connector is in contact or nearly in contact with said orientation bar means, said orientation bar means further having a plurality of holes from the top surface of said orientation bar means and extending through a bottom surface of the orientation bar means, each hole being positioned under the corresponding coax cable in order to permit the corresponding drain wire of the coax cable to be inserted through the hole with the end portion of drain wire bent across the bottom surface of the orientation bar means; and (c) ground termination block means, having a top surface placed opposite the bottom surface of the orientation bar means and fixed against the drain wires bent across the bottom surface of the orientation bar means, for causing the drain wires to be in pressure contact between the ground termination block means and the orientation bar means, wherein at least one of said ground termination block means or said orientation bar means is made of an electrically conducting material.

2. A connector, according to claim 1 wherein said orientation bar means further includes a plurality of slots, each slot corresponding to a coax cable and placed along a top surface of said orientation bar means such that the slot extends along an entire width of said orientation bar means and extends parallel to said coax cable, thereby providing a defined area of the top surface of said orientation bar means in which said corresponding coax cable rests, each slot contains one of said corresponding holes.

3. A connector, according to claim 2, wherein said ground termination block means further includes a protrusion rising above said top surface and extending the length of said ground termination block means, such that the end portion of all the drain wires extend across said protrusion.

4. A connector, according to claim 3, which said orientation bar means further includes an indentation notched in the bottom surface and extending the length of the orientation bar means such that the protrusion of the ground termination block effectively mates with said indentation.

5. A connector, according to claim 4, further comprising a top bar means for holding said coax cables in the corresponding slot of said orientation bar means, said top bar means placed across the coax cables and aligned above the top surface of said orientation bar means, and fastened to said orientation bar means such that said coax cables are held in pressure contact between said top bar means and said orientation bar means.

6. A connector, according to claim 5, wherein said orientation bar means further includes a step at both ends of said orientation bar means and outside the area of said drain wires, the height of said step being slightly smaller than the diameter of said drain wires in order to avoid a shearing of the drain wires when said drain wires are held in pressure contact between the protrusion of said ground termination block means and the indentation of said orientation bar means.

7. A connector, according to claim 5, further comprising a top bar means for holding said coax cables in the corresponding slot of said orientation bar means, said top bar means placed across the coax cables and aligned above the top surface of said orientation bar means, and fastened to said orientation bar means such that said coax cables are held in pressure contact between said top bar means and said orientation bar means.

8. A connector, according to claim 1, wherein said ground termination block means further includes a protrusion rising above said top surface and extending the length of said ground termination block means, such that the end portion of all the drain wires extend across said protrusion.

9. A connector, according to claim 8, which said orientation bar means further includes an indentation notched in the bottom surface and extending the length of the orientation bar means such that the protrusion of the ground termination block effectively mates with said indentation.

10. A connector, for providing electrical connections for a coax cable harness, wherein the coax cable harness includes a plurality of coax cables, each coax cable having a wire encased in a dielectric and having a drain wire, said connector comprising:

(a) an insulation displacement connector, having a plurality of insulation displacement contacts made of an electrically conducting material and set in a top surface of said insulation displacement connector and arranged in at least one row, each insulation displacement contact engaging a corresponding wire encased in said dielectric, said insulation displacement contact piercing said dielectric thereby providing the electrical connectin for the wire of the coax cable; and (b) orientation bar means made of an electrically conducting material, for positioning said coax cables to be in line with the corresponding insulation displacement contact, said coax cables resting on a top surface of said orientation bar means, said orientation bar means being positioned next to said insulation displacement connector such that the drain wires of each coax cable are in a space between a side surface of the orientation bar means and a side surface of the insulation displacement connector, the space being sufficiently narrow to cause the drain wires of each coax cable to physically contact said orientation bar means, thereby causing an electrical connection between the drain wires and the orientation bar means.

11. A connector, for providing electrical connections for a coax cable harness, wherein the coax cable harness includes a plurality of coax cables, each coax cable having a wire encased in a dielectric and having a drain wire, said connector comprising:

(a) an insulation displacement connector, having a plurality of insulation displacement contacts made of an electrically conducting material and set in a top surface of said insulation displacement connector and arranged in at least one row, each insulation displacement contact engaging a corresponding wire encased in said dielectric, said insulation displacement contact piercing said dielectric thereby providing the electrical connection for the wire of the coax cable; and (b) orientation bar means, for positioning said coax cables to be in line with the corresponding insulation displacement contact, said coax cables resting on a top surface of said orientation bar means, said orientation bar means being positioned next to said insulation displacement connector such that the drain wires of each coax cable are in a space between a side surface of the orientation bar means and a side surface of the insulation displacement connector, the side surface of at least one of the orientation bar means and the insulation displacement connector having a metallic bar extending the length of the surface and protruding above the side surface sufficient to contact each of the drain wires, the space being sufficiently narrow to cause the drain wires of each coax cable to physically contact said metallic bar thereby causing an electrical connection between all of the drain wires.

12. A method of connecting a coax cable harness to a connector, the coax cable harness including a plurality of coax cables, each coax cable having a wire encased in a dielectric and having a drain wire, each coax cable having been stripped of an outer jacket and accompanying shield, and wherein the connector includes an insulation displacement connector having insulation displacement contacts, and an orientation bar positioned next to said insulation displacement connector, the orientation bar having holes along the length of the orientation bar for each coax cable position opposite each insulation displacement contact, and further wherein each drain wire of the coax cable is bent at about right angles to the length of the coax cable at the point where the outer jacket has been stripped, the method comprising the steps of:

(a) inserting the drain wire in a first hole of said orientation bar such that the coax cable is resting essentially on a top surface of said orientation bar;

(b) bending the end portion of the drain wire, which extends from outside the hole at the bottom surface of the orientation bar, parallel to the coax cable;

(c) forcibly inserting the wire encased in the dielectric in the corresponding insulation displacement contact;

(d) repeating steps (a)–(c) for the next adjacent coax cable until all the cables have been connected to the corresponding insulation displacement contact;

(e) placing a ground termination block along the bottom surface of the orientation bar such that the drain wires are between the orientation bar and the ground termination block; and (f) fastening the ground termination block to the orientation bar such that the drain wires are held in pressure contact with the ground termination block.

13. A method according to claim 11, wherein the step of fastening further comprises the steps of:

(a) positioning a top bar across the top of the coax cables; and (b) fastening the ground termination block, the top bar, and the orientation bar such that the coax cables are held in position between the top bar and the orientation bar, and the drain wires are held in pressure contact between the orientation bar and the ground termination block.

* * * * *

UNITED STATES PATENT AND TRADEMARK OFFICE

CERTIFICATE OF CORRECTION

PATENT NO. : 4,662,067

DATED : May 5, 1987

INVENTOR(S) : Ronald F. Abraham

It is certified that error appears in the above—identified patent and that said Letters Patent is hereby corrected as shown below:

Col. 3, Line 63, before "Fig. 3A" insert --of--

Col. 8, Line 43, change "5" to --2--

Col. 9, Line 9, change "connectin" to --connection--

Signed and Sealed this

Tenth Day of November, 1987

*Attest:*

DONALD J. QUIGG

*Attesting Officer*

*Commissioner of Patents and Trademarks*